United States Patent [19]

Daugherty

[11] Patent Number: 4,901,864

[45] Date of Patent: Feb. 20, 1990

[54] GROOVED SPACER FOR DISC SCREEN WOOD CHIP SORTER

[75] Inventor: William D. Daugherty, Hattiesburg, Miss.

[73] Assignee: International Paper Company, Purchase, N.Y.

[21] Appl. No.: 232,733

[22] Filed: Aug. 16, 1988

[51] Int. Cl.[4] ..... B07B 13/04

[52] U.S. Cl. ..... 209/672; 209/667

[58] Field of Search ..... 209/667, 671, 672, 361, 209/674; 198/382

[56] References Cited

U.S. PATENT DOCUMENTS

| | | | |
|---|---|---|---|
| 3,265,206 | 8/1966 | Allen | 209/672 |
| 4,037,723 | 7/1977 | Wahl et al. | 209/672 |
| 4,301,930 | 11/1981 | Smith | 209/672 X |
| 4,452,694 | 6/1984 | Christensen et al. | 209/672 |
| 4,653,648 | 3/1987 | Bielagus | 209/672 |

FOREIGN PATENT DOCUMENTS

| | | | |
|---|---|---|---|
| 746178 | 11/1931 | France | 209/672 |
| 1142012 | 2/1985 | U.S.S.R. | 209/672 |

*Primary Examiner*—Donald T. Hajec

*Attorney, Agent, or Firm*—Walt Thomas Zielinski

[57] ABSTRACT

A disc screen wood chip sorter of the type having a series of corotating shafts, each of which is provided with an axially spaced series of concentric discs. The peripheries of the discs carried by one shaft interdigitate with those of the next adjacent shafts. The discs on any one shaft are maintained in parallelism by spacer elements in the general form of short cylindrical washers. The specific improvement of this invention relates to a novel configuration of these spacing elements. Each spacer end is provided with a flange to thereby define a central, annular groove or recess between the flanges, each annular receiving recess receiving a portion of the periphery of an adjacent disc, i.e., a disc mounted on a neighboring shaft. By virtue of this novel form of disc spacer, the disc screen sorter severely inhibits the passage of wood chips of a thickness greater than intended, i.e., chips of a thickness greater than the spacing between interdigitated discs. The use of discs with longitudinal thickness less than the desired thickness sort fully enhances the desirable effects of the novel spacer.

6 Claims, 2 Drawing Sheets

FIG. 3
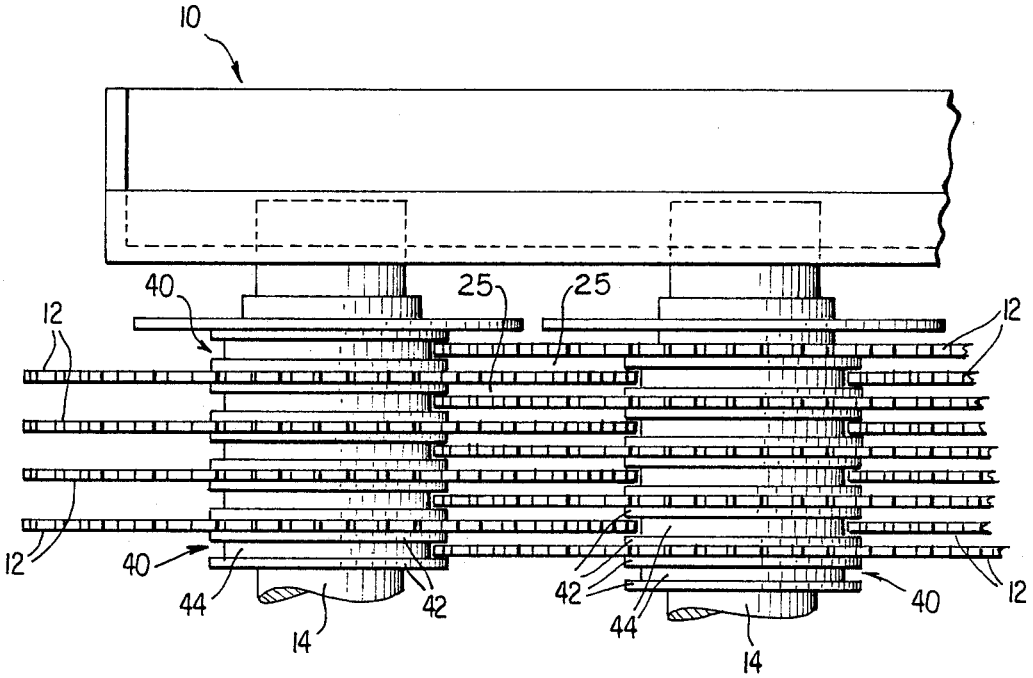
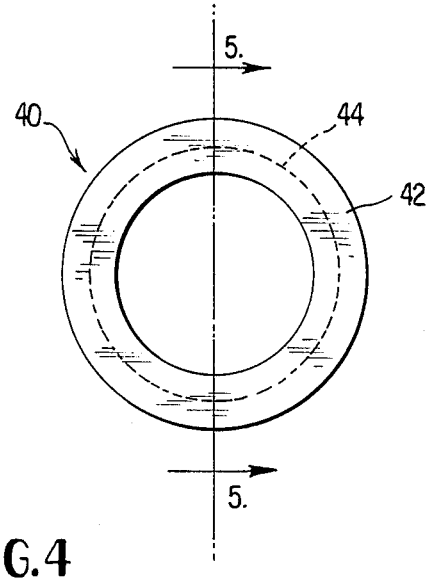
FIG. 4
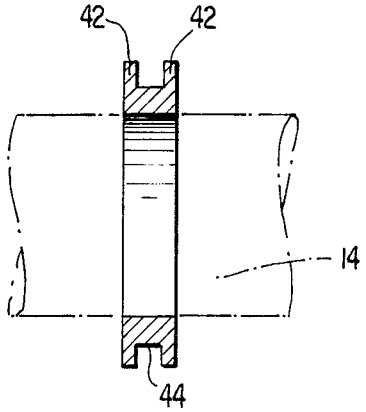
FIG. 5

GROOVED SPACER FOR DISC SCREEN WOOD CHIP SORTER

BACKGROUND OF THE INVENTION

This invention relates to a wood chip sorter and more particularly to a wood chip sorter of the disc screen type comprising a plurality of horizontally rotating shafts, each shaft provided with a plurality of parallel discs spaced axially therealong. The outermost peripheries of the discs of adjacent shafts interdigitate with each other, to thereby define a lateral clearance between them. The discs are commonly provided with teeth at their peripheries. In operation, the wood chips are continuously fed to one top end of the disc screen. Only those sizes of wood chips equal to or smaller than the clearance defined by the interdigitated discs should fall through the apparatus, with the remainder advanced to the outfeed end of the separator.

The prior art is aware of a variety of construction of sorters of separators of this general type, as may be seen for example by reference to U.S. Pat. Nos. 4,301,930, issued to Smith, and 4,452,694, issued to Christiansen.

While generally satisfactory for the purpose of sorting wood pulp chips, it has been observed that some larger than desired chips pass through the sorter, even with very precisely constructed components of the device. In one spacially constructed test sorter having a 2 mm spacing between the interdigitated discs, and with thin discs of less than 2 mm longitudinal thickness, wood chips of 2 mm to 5 mm were still able to pass through. This is apparently due to the teeth on the periphery of the rotating discs engaging such a relatively thick chip and forcing it, due to the resiliency of the wood, through the radial clearance between a tooth and the shaft of a next adjacent set of discs.

The relative quantity of relatively thick chips passing the specially constructed screen with thin discs was less than the quantity of relatively thick chips passing another 2 mm screen with very thick discs. This difference appeared to be a function of chip width. Study of the problem revealed that thick discs allowed a wider space between two adjacent discs on the same shaft, and thereby allowed wider chips (regardless of thickness) to reside between these adjacent discs. This provided the opportunity for the wider chip to be forced between the shaft and a disc tooth of an adjacent set of discs.

SUMMARY OF THE INVENTION

According to the practice of this invention, the passage through the disc screen sorter of wood chips of a greater than desired dimension is inhibited by a novel grooved spacer. This spacer is used instead of the conventional spacers. The use of discs with longitudinal thickness less than the desired thickness sort fully enhances the desirable effects of using the grooved spacer.

The grooved spacer of this invention allows a well-constructed disc screen to make an accurate thickness classification, i.e., sorting of desired wood chip sizes.

The grooved spacer of this invention is intended to cover the lateral peripheral surfaces of the disc teeth when they approach an opposing shaft. This effectively prevents large wood chip pieces from being compressed by the teeth of the discs and being forced through the space between the disc teeth and the opposing shaft. This grooved spacer construction further prevents large chip material from riding in the valley of a disc tooth and passing through the disc screen. The maximum chip size which can pass through the disc screen by riding in the valley of a disc tooth is most precisely controlled when the discs are of a longitudinal thickness of less than the desired thickness sort. Thus, whatever passes through the active part of the disc screen will be no thicker than the distance between opposing discs, this being the desired classification or sorting size. Further, the clearance or tolerances between the tip of the disc teeth and the adjacent shafts is not critical, since the disc teeth are effectively shielded by the grooved spacer of this invention.

BRIEF DESCRIPTION OF THE DRAWINGS

FIG. 3 is a plan view of a portion of a disc screen provided with the grooved spacer of this invention.

FIG. 4 is a side elevational view of the disc spacer of this invention.

FIG. 5 is a view taken at section 5—5 of FIG. 4.

DETAILED DESCRIPTION OF THE INVENTION

Figure 1:
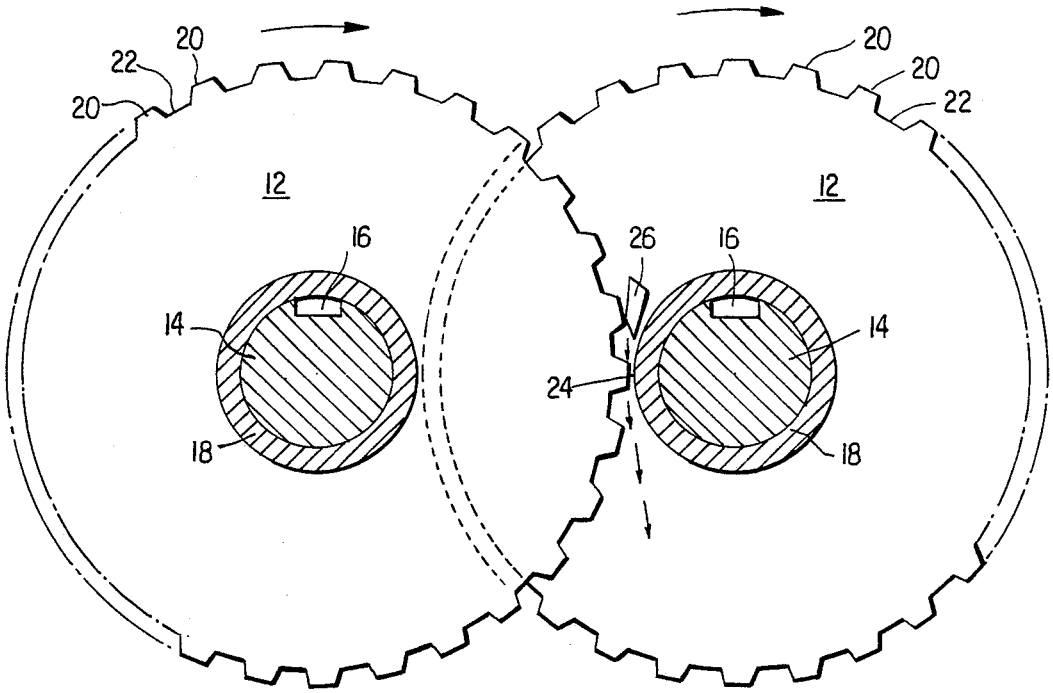
FIG. 1 (PRIOR ART)
FIG. 1 is a partial transverse elevational view of a portion of a typical prior art disc screen.
Figure 2:
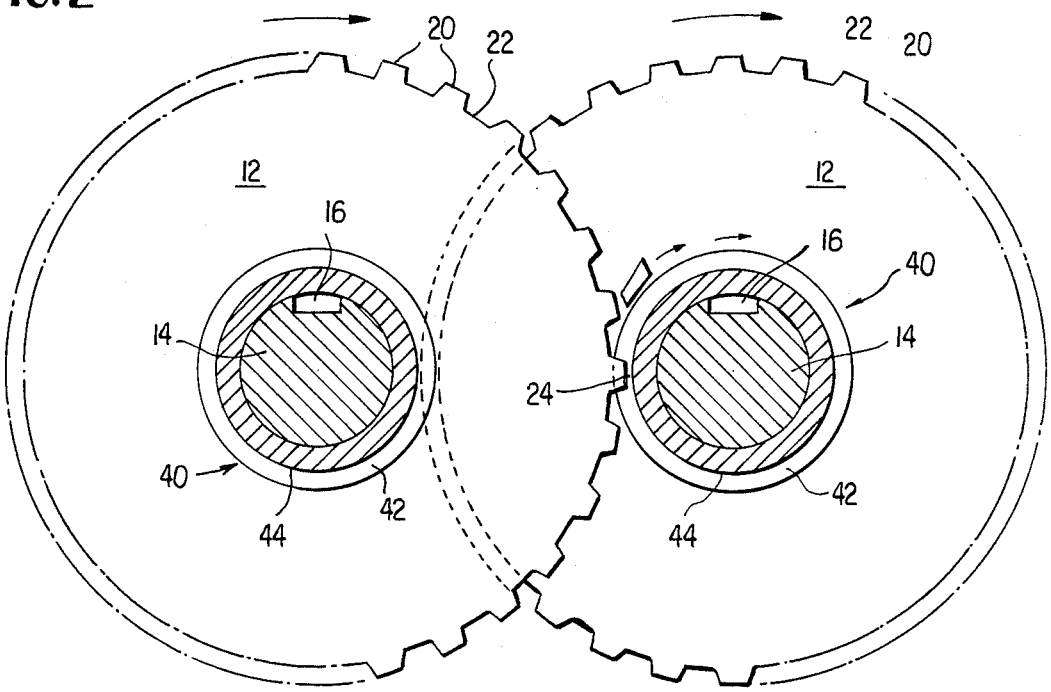
FIG. 2 is a view similar to FIG. 1, and illustrates the present invention.

Referring now to FIG. 1 of the drawings, a typical prior art disc screen construction is illustrated, with only two of the several shafts and a single disc of each shown. Numeral 12 denotes a typical disc on a first shaft 14, each disc being provided with an integral key tab 16 fitting into a complementary longitudinal groove on shaft 14. The numeral 18 denotes a spacer element or washer for maintaining adjacent discs 12 apart and in parallelism on shaft 14. These spacer washers are similar to elements 17 of the noted Smith patent, and 14 of the noted Christiansen patent. The numeral 20 denotes any one of a plurality of teeth on the periphery of disc 12, while the numeral 22 denotes a corresponding valley between any two teeth. A minimum radial clearance 24 exists between the outermost portion of any tooth 20 and the exterior surface of spacer washer 18. The outermost portion or tip of any tooth 20 follows a circular path. The path includes a location where the tips approach an adjacent shaft, thereby defining the aforementioned minimum radial clearance.

The numeral 26 denotes a relatively thick chip, of greater size than the inner face opening (IFO) of the sorter, and typically of a dimension 5 mm×5 mm (for a 2 mm screen with thin discs), and of any length. With prior sorter constructions, it has been observed that sometimes thick chips, such as chip 26, will pass through the disc screen. Careful examination of such oversized chips shows that these thick chips were actually squeezed between the teeth 20 of a disc 12 and the opposing spacer 18, i.e., squeezed through the radial clearance 24, even though this clearance 24 was less than 0.5 mm. The chips were imprinted by the disc teeth 20. With moist wood chips, the wood is partially resilient and partly sprang back so as to make the tooth imprint difficult to observe. FIG. 1 shows a typical prior art construction, wherein a distance of 2 mm is the inner face opening (IFO) between interdigitating discs 12 of adjacent shafts. In the static mode of the disc screen (for examination purposes only) tests showed that no chips thicker than 2.2 mm could be easily forced through the screen, either by hand or with the aid of tweezers. Accordingly, the conclusion was reached that rotation of the discs effected the described action of passage of larger than desired chips through the disc screen.

Referring now to FIGS. 2 to 5, the grooved spacer of this invention and its cooperation with the remaining elements of the disc screen will be described. In these Figures, the numeral 40 denotes generally the grooved spacer of this invention and comprises two parallel, circular flanges 42 integrally connected by and located at the ends of a central short cylinder or washer 44. The same minimum radial clearance 24, between the outermost portion of any tooth 20 and the exterior surface of 44, is present with the disc sorter construction of FIG. 2, but now the lateral or side surfaces of teeth 20 are covered (but not contacted) by flanges 42 of the spacer washer 40. Flanges 42 thus diminish the lateral clearance 25 between the sides of teeth 20 and those respective discs 12 which sandwich them only at those locations where the teeth of any disc approach an adjacent shaft by substantially filling the lateral clearance therebetween. This covering of the side surfaces of at least the radially outermost portions of teeth 20 is clearly seen in FIG. 2.

The invention is conveniently practiced by substituting the novel spacer elements 40 for their prior art counterparts 18, the latter being merely short cylinders. The diminishing of the lateral or side clearance between the teeth and their corresponding disc pairs may also be carried out by several grooved washers (washers and spacers) longitudinally joined together, permanently, or by compression, to form the grooved spacers. Further, counterparts of the flanges 42 may be formed integrally with shaft 14 as by forming grooves on any shaft 14. Further, the discs 12 themselves may integrally carry portions corresponding in location and thickness to flanges 42. Further, the novel spacer elements 40 may fit onto square or polygonal shafts instead of the round shaft 14. Further, the novel spacer element may fit and function on disc screens wherein the plurality of rotating shafts are parallel to one another, but not horizontally disposed, and may also function on disc screens wherein the discs are not all of a common diameter.

Typical dimensions of a disc screen apparatus provided with the grooved spacer of this invention are as follows. The discs 12 are approximately 4.25 inches in diameter, and of 0.072 inch thickness, with shafts 14 being one inch in diameter. The thickness of portions 42 is 0.070 inches, with the space between their facing surfaces, above portion 44, being 0.090 inches. The total axial dimension, along shaft 14, is 0.226 inches. The axial spacing 25 between the surfaces of interdigitated discs 12 is typically 2 mm, as shown as FIG. 3, this being the noted IFO spacing. This space may be the same in a disc screen of this invention as that of the prior art, with all dimensions of the grooved spacer adjusted to fit the prior art discs and shafts. The outer surfaces of flanges 42 may be knurled or otherwise provided with a rough or contoured outer peripheral edge.

I claim:

1. A disc screen apparatus for sorting wood pulp chips by size said apparatus including a plurality of parallel shafts, each shaft being rotatable and carrying a plurality of uniformly spaced parallel discs, each of said discs having teeth disposed about its periphery, each tooth having a radially outermost portion including a tip, a portion of the periphery of any one of said discs on one of said shafts being sandwiched by side portions of a corresponding pair of the discs of a next adjacent shaft, and the sandwiched discs being spaced so as to define the maximum size of wood chips which are to pass through said disc screen apparatus, there being a minimum radial clearance between the tips of the teeth of any disc and a corresponding next adjacent shaft, each said tip following a circular path, said path including a location where the tips approach an adjacent shaft to define said minimum radial clearance, there being a lateral clearance between a radially outermost side surface portion of the teeth of any disc and the side portions of two corresponding discs which sandwich it, said lateral clearance being equal to the spacing between said sandwiched discs, and means at the locations where the tips of said teeth of any disc approach an adjacent shaft for substantially diminishing the lateral clearance between the radially outermost side surface portions of the teeth and the side portions of the discs which sandwich them, by substantially filling the lateral clearance therebetween, whereby said means effectively prevents larger than desired wood chips from being compressed by the teeth and being forced through said radial clearance.

2. The disc screen apparatus of claim 1 including a plurality of spacer elements, each having a cylindrical external surface, on each of said shafts to thereby maintain the discs on the shafts spaced from each other, and wherein said means is defined by flanges carried by said spacer elements, each spacer element having two of said flanges, said flanges being of a diameter greater than the spacer element diameter, the flanges covering the outermost portions of the teeth of a corresponding disc when the latter approach a corresponding adjacent shaft.

3. The disc screen apparatus of claim 1 wherein each of said shafts is rotatable in the same direction and wherein said shafts are disposed in one plane.

4. The disc screen apparatus of claim 2 wherein said flanges are located at the ends of said spacer elements.

5. The disc screen apparatus of claim 1 wherein each disc is of longitudinal thickness of less than the thickness of the maximum size of wood chip which is to pass through said disc apparatus.

6. The disc screen apparatus of claim 1 wherein said parallel discs are of the same diameter.

* * * * *